United States Patent [19]

Greenwald

[11] Patent Number: 4,911,882

[45] Date of Patent: Mar. 27, 1990

[54] PROCESS FOR PRODUCING PERMANENT MAGNETS

[75] Inventor: Frank S. Greenwald, Woodstock, Ill.

[73] Assignee: SPS Technologies, Inc., Newtown, Pa.

[21] Appl. No.: 308,322

[22] Filed: Feb. 8, 1989

[51] Int. Cl.[4] ..... G22F 1/00

[52] U.S. Cl. ..... 419/12; 148/103; 148/105; 148/108; 148/301; 148/302; 148/DIG. 115; 252/62.55; 419/23; 419/30; 419/32; 419/33; 419/38; 419/57

[58] Field of Search ..... 252/62.55; 148/103, 148/105, 108, 301, 302, DIG. 115; 419/23, 12, 57, 38, 30, 32, 33

[56] References Cited

U.S. PATENT DOCUMENTS

| | | | |
|---|---|---|---|
| 4,197,146 | 4/1980 | Frischmann | 148/103 |
| 4,369,075 | 1/1983 | Nobuo | 148/103 |
| 4,401,482 | 8/1983 | Green et al. | 419/36 |
| 4,734,131 | 3/1988 | Arai et al. | 148/108 |
| 4,770,702 | 9/1988 | Ishigaki et al. | 419/36 |
| 4,776,902 | 10/1988 | Ghandehari | 148/103 |

*Primary Examiner*—Stephen J. Lechert, Jr.
*Attorney, Agent, or Firm*—James D. Dee; Aaron Nerenberg

[57] ABSTRACT

The present invention relates to the preparation of permanent magnet materials of the Iron-Boron-Rare Earth type.

2 Claims, 1 Drawing Sheet

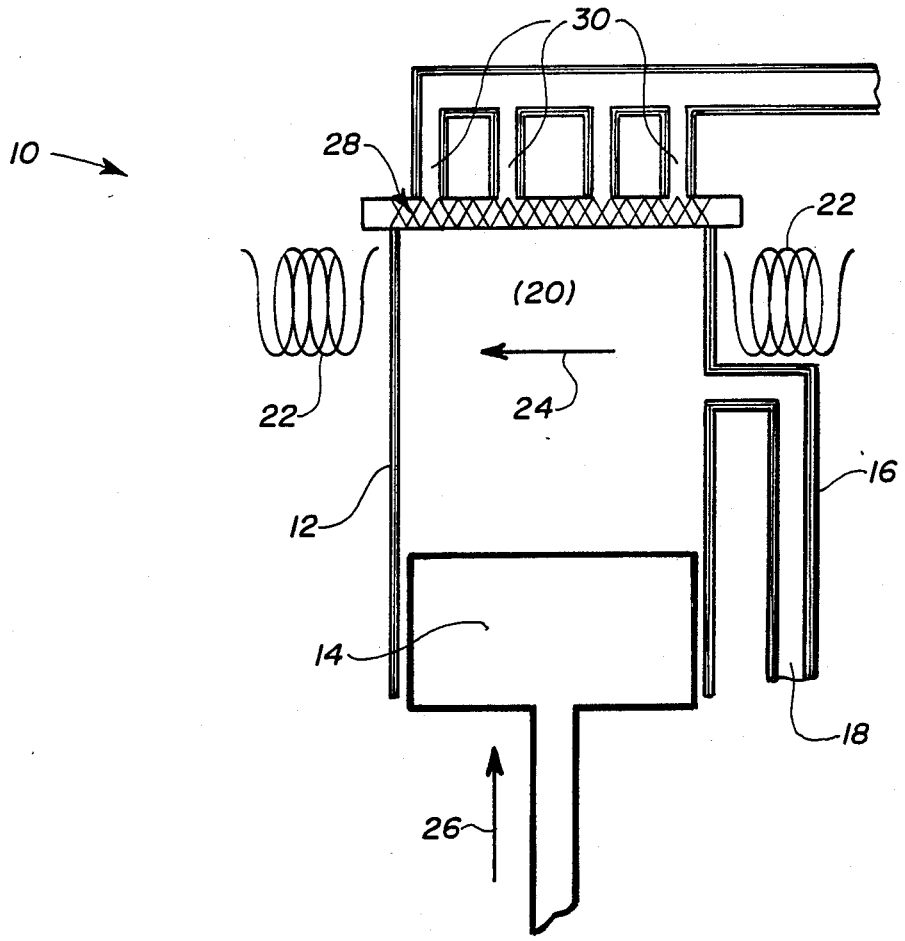
30
10
28
22
(20)
22
24
16
12
14
18
26

PROCESS FOR PRODUCING PERMANENT MAGNETS

BACKGROUND OF THE INVENTION

Permanent magnets have long been known and used at least since the first primitive compass was used in navigation. Today permanent materials are used extensively in electric and electronic assemblies. With the increased miniaturization and high efficiency of electrical equipment there has been an increasing demand for permanent magnet materials having higher coercive forces and energy products.

Typical permanent magnet material currently in use are alnico, hard ferrite and rare earth/cobalt magnets. The rare earth/cobalt magnets are capable of high magnetic properties, but are very expensive because they require the rare earth element, samarium, which is relatively scarce, and cobalt, the supplies of which have been uncertain in recent years.

In recent years new magnetic materials have been introduced containing iron, various rare earth elements and boron. Such magnets have been prepared from melt quenched ribbons and also by the technique of compacting and sintering which had been employed to produce samarium cobalt magnets.

U.S. Pat. No. 4,597,938 to Matsuura, Sagawa and Fujimura shows a process for the production of permanent magnet materials of the Iron-Boron-Rare Earth type in which the materials are prepared as a metallic powder compacted and sintered at high temperature while being held in a non-oxidizing or reducing atmosphere. U.S. Pat. No. 4,601,875 to Yamamota, Sagawa, Fujimura and Matsuura shows a similar process for producing magnetic materials but with the additional step that the sintered body is heat-treated at a temperature above 350° C. still in a nonoxidizing atmosphere. The teachings of these references, both assigned to Sumitomo Special Metals Co., Ltd. are incorporated by reference herein.

In the compaction of the magnetic powder, however, certain problems arise. It is useful, for example, to apply a strong external magnetic field to orient the particles prior to compacting. Because an assembly of dry particles have limited mobility, however, it is often difficult to achieve a high degree of alignment. Secondly, and also because the dry particles have limited mobility, the compacted powder often has one or more voids or discontinuities where the compaction is not uniform and homogeneous.

In the preparation of hard ferrite magnetic materials, similar problems are overcome by dispersing the magnetic ferrite particles in water and wet pressing the resulting dispersion.

OBJECTS OF THE PRESENT INVENTION

It is an object of the present invention to provide a process for the preparation of permanent magnetic materials with increased orientation of the individual particles of metallic material.

It is a further object of the present invention to provide a process for the preparation of permanent magnetic materials with improved uniformity and homogeneity and freedom from voids.

The other objects, features and advantages of the present invention will become more apparent in light of the following detailed description of the preferred embodiment thereof.

According to one embodiment of the present invention there is shown a process for the preparation of permanent magnet materials of the Iron-Boron-Rare Earth type, which process comprises the steps of:

(a) in a non-oxidizing or reducing atmosphere preparing a metallic powder having a mean particle size of about 0.3 to about 80 microns and a composition by atomic percent consisting of:

(i) a rare earth component comprising from about twelve percent (12%) to about twenty-four percent (24%) of the overall composition and comprising at least one rare earth element selected from the group consisting of neodymium, praseodymium, lanthanum, cerium, terbium, dysprosium, holmium, ytterbium, lutetium, and yttrium, and wherein at least fifty percent (50%) of said rare earth component consists of neodymium, praseodymium or a combination thereof;

(ii) a boron component comprising from about four percent (4%) to about twenty-four percent (24%) of the overall composition and comprising boron; and, (iii) an iron component comprising at least fifty-two percent (52%) of the overall composition and comprising iron;

(b) compacting said metallic powder by:

(i) dispersing the metallic powder in a suitable fluid;

(ii) orienting the dispersed particles of metallic powder by application of an external magnetic field to produce an oriented dispersion;

(iii) maintaining the orientation of the dispersion while wet-pressing the oriented dispersion to remove substantially all of the fluid and compact the oriented metallic powder; and (iv) drying the compacted metallic powder to remove residual fluid; and (c) sintering the compacted metallic powder in a non-oxidizing or reducing atmosphere at a temperature of from about nine hundred degrees centigrade (900° C.) to about twelve hundred degrees centigrade (1200° C.) to form a sintered body.

According to another embodiment of the present invention there is provided a process for the preparation of permanent magnet materials of the Iron-Boron-Rare Earth type, which process comprises the steps of:

(a) in a non-oxidizing or reducing atmosphere preparing a metallic powder having a mean particle size of about 0.3 to about 80 microns and a composition consisting of, by atomic percent, (i) a rare earth component comprising from about twelve percent (12%) to about twenty-four percent (24%) of the overall composition and comprising at least one rare earth element selected from the group consisting of neodymium, praseodymium, holmium, erbium, europium, samarium, gadolinium, promethium, thulium, ytterbium, lutetium and yttrium, and wherein at least fifty percent (50%) of said rare earth component consists of neodymium, praseodymium or a combination thereof;

(ii) a boron component comprising from about four percent (4%) to about twenty-four percent (24%) of the overall composition and comprising boron; and (iii) an iron component comprising at least fifty-two percent (52%) of the overall composition and comprising iron;

(b) compacting said metallic powder by:

(i) dispersing the metallic powder in a suitable fluid;

(ii) orienting the dispersed particles of metallic powder by application of an external magnetic field to produce an oriented dispersion;

(iii) maintaining the orientation of the dispersion while wet-pressing the oriented dispersion to remove substantially all of the fluid and compact the oriented metallic powder; and (iv) drying the compacted metallic powder to remove residual fluid; and (c) sintering the compacted metallic powder at a temperature of from about nine hundred degrees centigrade (900° C.) to about twelve hundred degrees centigrade (1200° C.) while in a non-oxidizing or reducing atmosphere to form a sintered body; and, (d) heat-treating the sintered body of step (c) at a temperature ranging from about three hundred fifty degrees centigrade (350° C.) to about the sintering temperature of step (c) while still in a non-oxidizing or reducing atmosphere to produce a heat treated sintered body.

BRIEF DESCRIPTION OF THE DRAWING

The drawing illustrates the process of the present invention.

DETAILED DESCRIPTION OF THE PREFERRED EMBODIMENT

In the practice of the present invention, a sintered body of permanent magnetic materials of the iron-boron-rare earth type having a higher degree of particle orientation and greater homogeneity is obtained. As in the prior art, particularly U.S. Pat. No. 4,597,938 to Matsuura, Sagawa and Fujimura, a metallic powder having a mean particle size of about 0.3 to about 80 microns is prepared by grinding, in a non-oxidizing or reducing atmosphere, a composition by atomic weight percent consisting of:

(i) a rare earth component comprising from about twelve percent (12%) to about twenty-four percent (24%) of the overall composition and comprising at least one rare earth element selected from the group consisting of neodymium, praseodymium, lanthanum, cerium, terbium, dysprosium, holmium, erbium, europium, samarium, gadolinium, promethium, thulium, ytterbium, lutetium, and yttrium, and wherein at least fifty percent (50%) of said rare earth component consists of neodymium, praseodymium or a combination thereof;

(ii) a boron component comprising from about four percent (4%) to about twenty-four percent (24%) of the overall composition and comprising boron; and (iii) an iron component comprising at least fifty-two percent (52%) of the overall composition and comprising iron.

In the prior art, this metallic powder, is dry form, would be compacted to form a compacted metallic powder, usually while in the presence of a strong external magnetic field. Because of the limited mobility of such an assembly of particles in a dry powder however, it is often difficult to achieve a high degree of alignment. In addition, and also because the dry particles have limited mobility, the compacted body often has one or more voids or discontinuities where the composition is not uniform and homogeneous.

In the present invention, these difficulties are overcome in compacting the metallic powder. The particles of the metallic powder are first dispersed in a suitable fluid.

Various organic and inorganic solvents may be used as the fluid carrier for this purpose, and hexane has been used advantageously.

Once the particles of metallic powder have been dispersed in the fluid, they are oriented by the application of an external magnetic field to produce an oriented dispersion. In practice this may be done by positioning the dispersion within the field produced by the coils of an electromagnet.

While the dispersion of metallic particles is maintained in such an oriented condition, the particles are compacted to form an oriented, compacted body. This is typically done in some kind of a pressing operation.

With reference to the drawing, this process is illustrated. A wet pressing apparatus suitable for the practice of the present invention is illustrated generally as (10). This apparatus consists generally of a cylinder (12) and piston (14), although the invention is by no means limited to circular compacted bodies and other shapes can be easily obtained. Conduit (16) permits the introduction of a fluidized dispersion of metallic particles through intake channel (18) into the forming area (20).

Forming area (20) is subjected to an external magnetic field, in this illustration created by passing an electric current through electromagnet coils (22). It should be noted that the external magnetic field, arbitrarily given the direction (24) in this illustration, could be in any convenient direction by the suitable placement of coils or equivalent means. The magnetic field, therefore, might be in the direction of travel of the piston (14), at right angle thereto, or in any other desired direction.

In practice, a fluidized flow of metallic particles is introduced into forming area (20) by conduit (16) from intake channel (18) and the particles are oriented by the external magnetic field (24) generated by electromagnetic coils (22) or other suitable means. Because the particles are dispersed in a fluid carrier, they have greater mobility and are able to achieve a higher degree of orientation. While the particles are thus held in such oriented condition, action of the piston in the direction (26) cuts off the flow of fluidized particles of metallic powder from conduit (16) and compresses the dispersion.

Screen (28), which is permeable to the fluid, but which is impermeable to the particles of metallic powder, allows the fluid carrier to be driven out of forming area (20) by the action of piston (14). Collection channels (30) allow the fluid carrier to be collected for reuse. In this manner, action of the piston (14) effects removal of the fluid carrier and compaction of the oriented metallic particles. Because the particles are dispersed in a fluid carrier during this process, they have greater mobility and are able to fill the forming area (20) more uniformly, creating a more uniform, homogeneous compacted body.

At some predetermined point in the process an effective equilibrium would be reached with respect to continued fluid removal in this manner. The compacted body would then be removed from the forming area (20) by some suitable method, such as by opening away the screen (28). Then the screen (28) could be returned to its original position, the piston (14) withdrawn to a position which would once again permit the flow of fluidized metallic particles into the forming area (20)

from conduit (16) and the above-described process could be repeated.

Once removed from the forming area (20) the compacted body would still contain some residual carrier fluid which should be substantially removed before further processing. Removal can be obtained by drying, vacuum drying or other suitable means known to the art.

The compacted body of oriented metallic powder may then be further processed to form a sintered body. As shown in the above-cited prior art reference, the compacted body of oriented metallic powder may be sintered at a temperature of from about nine hundred degrees centigrade (900° C.) to about twelve hundred degrees centigrade (1200° C.) while still in a non-oxidizing or reducing atmosphere for a sintered body.

Alternatively, the sintered body obtained in this manner may be heat-treated as disclosed in U.S. Pat. No. 4,601,875 to Yamamota, Sagawa, Fujimura and Matsuura. This reference shows a similar process for producing magnetic materials but with the additional step that the sintered body is heat-treated at a temperature about three hundred fifty degrees centigrade (350° C.) still in a non-oxidizing atmosphere.

It will be evident that the terms and expressions that have been employed herein are used as terms of description and not of limitation. There is no intention in the use of such terms and expressions of excluding equivalents of the features shown and described or portions thereof, and it is recognized that various modifications are possible within the scope of the invention claimed.

What is claimed is:

1. A process for the preparation of permanent magnet materials of the Iron-Boron-Rare Earth type, which process comprises the steps of:

(a) in a non-oxidizing or reducing atmosphere preparing a metallic powder having a mean particle size of about 0.3 to about 80 microns and a composition by atomic percent, consisting of, (i) a rare earth component comprising from about twelve percent (12%) to about twenty-four percent (24%) of the overall composition and comprising at least one rare earth element selected from the group consisting of neodymium, praseodymium, lanthanum, cerium, terbium, dysprosium, holmium, erbium, europium, samarium, gadolinium, promethium, thulium, ytterbium, lutetium, and yttrium, and wherein at least fifty percent (50%) of said rare earth component consists of neodymium, praseodymium or a combination thereof;

(ii) a boron component comprising from about four percent (4%) to about twenty-four percent (24%) of the overall composition and comprising boron; and (iii) an iron component comprising at least fifty-two percent (52%) of the overall composition and comprising iron;

(b) compacting said metallic powder by:

(i) dispersing the metallic powder in a suitable fluid;

(ii) orienting the dispersed particles of metallic powder by application of an external magnetic field to produce an oriented dispersion;

(iii) maintaining the orientation of the dispersion while wet-pressing the oriented dispersion to remove substantially all of the fluid and compact the oriented metallic powder; and (iv) drying the compacted metallic powder to remove residual fluid; and (c) sintering the compacted metallic powder in a non-oxidizing or reducing atmosphere at a temperature of from about nine hundred degrees centigrade (900° C.) to about twelve hundred degrees centigrade (1200° C.) to form a sintered body.

2. A process for the preparation of permanent magnet materials of the Iron-Boron-Rare Earth type, which process comprises the steps of:

(a) in a non-oxidizing or reducing atmosphere preparing a metallic powder having a mean particle size of about 0.3 to about 80 microns and a composition consisting of, by atomic percent, (i) a rare earth component comprising from about twelve percent (12%) to about twenty-four percent (24%) of the overall composition and comprising at least one rare earth element selected from the group consisting of neodymium, praseodymium, holmium, erbium, europium, samarium, gadolinium, promethium, thulium, ytterbium, lutetium and yttrium, and wherein at least fifty percent (50%) of said rare earth component consists of neodymium, praseodymium or a combination thereof;

(ii) a boron component comprising from about four percent (4%) to about twenty-four percent (24%) of the overall composition and comprising boron; and (iii) an iron component comprising at least fifty-two percent (52%) of the overall composition and comprising iron;

(b) compacting said metallic powder by:

(i) dispersing the metallic powder in a suitable fluid (ii) orienting the dispersed particles of metallic powder by application of an external magnetic field to produce an oriented dispersion;

(iii) maintaining the orientation of the dispersion while wet-pressing the oriented dispersion to remove substantially all of the fluid and compact the oriented metallic powder; and (iv) drying the compacted metallic powder to remove residual fluid; and (c) sintering the compacted metallic powder at a temperature of from about nine hundred degrees centigrade (900° C.) to about twelve hundred degrees centigrade (1200° C.) while in a non-oxidizing or reducing atmosphere to form a sintered body; and, (d) heat-treating the sintered body of step (c) at a temperature ranging from about three hundred fifty degrees centigrade (350° C.) to about the sintering temperature of step (c) while still in a non-oxidizing or reducing atmosphere to produce a heat-treated sintered body.

* * * * *